US006036584A

United States Patent [19]

Swinkels et al.

[11] Patent Number: 6,036,584

[45] **Date of Patent: *Mar. 14, 2000**

[54] BLAST SYSTEM

[75] Inventors: Petrus H. W. Swinkels; Maarten H. Zonneveld; Henricus J. Ligthart, all of Eindhoven, Netherlands

[73] Assignee: U.S. Philips Corporation, New York, N.Y.

[ * ] Notice: Under 35 U.S.C. 154(b), the term of this patent shall be extended for 41 days.

[21] Appl. No.: 08/573,854

[22] Filed: Dec. 18, 1995

[30] Foreign Application Priority Data

Dec. 19, 1994 [EP] European Pat. Off. ..... 94203679

[51] Int. Cl.[7] ..... B24C 7/00

[52] U.S. Cl. ..... 451/75; 451/102

[58] Field of Search ..... 451/78, 75, 102, 451/29, 99, 101

[56] References Cited

U.S. PATENT DOCUMENTS

| | | | |
|---|---|---|---|
| 2,696,049 | 12/1954 | Black | 451/101 |
| 3,139,705 | 7/1964 | Histed . | |
| 3,425,166 | 2/1969 | Best et al. | 451/102 |
| 4,067,150 | 1/1978 | Merrigan | 451/102 |
| 4,482,322 | 11/1984 | Hain et al. | 451/101 |

FOREIGN PATENT DOCUMENTS 0562670 9/1993 European Pat. Off. .

*Primary Examiner*—Robert A. Rose
*Attorney, Agent, or Firm*—Robert J. Kraus

[57] ABSTRACT

A blast system for processing components by means of abrasive particles, comprising a hopper (1) for abrasive particles (2), a mixing device (3) formed by a mixing chamber (9) into which an HP-air pipe (10) issues and which in its turn issues into a blast pipe (11), a transport line (5) between the hopper and the mixing chamber, through which line the abrasive particles are transported from the hopper to the mixing chamber, means (6) for generating HP-air (P) which is supplied to the mixing chamber through the HP-air pipe for obtaining a mixture of air and abrasive particles issuing from the blast pipe, and a transport mechanism (4) for transporting the abrasive particles through the transport line. To obtain an energy-efficient system suitable for mass manufacture, the invention is characterized in that the system operates at an absolute pressure (P) of the HP-air of between 2 and 4.5 bar, while a ratio $d_1/d_2$ of a smallest diameter $d_1$ of the HP-air pipe issuing into the mixing chamber to a smallest diameter $d_2$ of the blast pipe lies between 0.6 and 0.9, while $P<13.25-12.5\ d_1/d_2)))$.

5 Claims, 1 Drawing Sheet

BLAST SYSTEM

BACKGROUND OF THE INVENTION

1. Field of the Invention

The invention relates to a blast system for processing components by means of abrasive particles, comprising a hopper for abrasive particles, a mixing device formed by a mixing chamber into which an HP-air pipe issues and which in its turn issues into a blast pipe, a transport line between the hopper and the mixing chamber through which the abrasive particles are transported from the hopper to the mixing chamber, means for generating HP-air which is supplied to the mixing chamber through the HP-air pipe for obtaining a mixture of air and abrasive particles which issues from the blast pipe, and a transport mechanism for transporting the abrasive particles through the transport line.

2. Description of the Related Art

Abrasive blast systems are mainly used for cleaning surfaces (blast cleaning), removing burrs from surfaces (deburring), and introducing compression stresses into a surface for raising the fatigue limit (shot peening). A fairly new application is the shaping of components of brittle material, for example for making a plurality of small cavities and/or holes in a plate of electrically insulating material as described in EP-A-0562670 (PHN 14.374). Accuracy is of major importance here. A high accuracy can only be obtained when it is ensured that both the flow density of the abrasive particles and the air output with which an operation is carried out are constant as much as possible. Thus it was found that the accuracy of the holes in the plate is strongly dependent on the inflow of the abrasive particles into the mixing chamber. The transport of the abrasive particles from the hopper to the mixing chambers is obtained in most blast systems through the creation of an underpressure in the mixing chamber by means of HP-air connected to the mixing chamber. The abrasive particles are attracted by suction owing to the underpressure. A major portion of the power supplied by a compressor is necessary for generating this underpressure. It is found, however, that the underpressure created in the mixing chamber by means of the HP-air does not lead to an even flow of abrasive particles from the blast pipe during the process. The system must therefore be provided with a separate transport mechanism for the abrasive particles. U.S. Pat. No. 3,139,705 discloses a sandblasting system, in particular for sandblasting of ships, wherein the transport of the abrasive particles is achieved by means of a vibratory mechanism, and not by means of an underpressure generated with HP-air. All these blast systems have operated until now at absolute HP-air pressures of approximately 7 bar. It requires very much power, however, to obtain such high pressures. Their use in mass manufacture is therefore very inefficient. Lowering of the operational pressure, however, is no solution because the speed with which the mixture leaves the blast pipe becomes too low, which is also inefficient.

SUMMARY OF THE INVENTION

It is an object of the invention to provide a blast system in which the flow density of the mixture of air and abrasive particles issuing from the blast pipe is as constant as possible, in combination with an energy efficiency which is as high as possible.

The invention is for this purpose characterized in that the system operates at an absolute pressure P of the HP-air of between 2 and 4.5 bar, while a ratio $d_1/d_2$ of a smallest diameter $d_1$ of the HP-air pipe issuing into the mixing chamber to a smallest diameter $d_2$ of the blast pipe lies between 0.6 and 0.9, while $P<13.25-12.5\ d_1/d_2)))$. In blast systems known until now, mixing devices are used in which the smallest diameter $d_1$ of the HP-air pipe is 3 mm and the smallest diameter $d_2$ of the blast pipe is 6 mm. The ratio $d_1/d_2$ between these diameters is accordingly 0.5. The invention is based on the recognition that a considerable reduction in the operational pressure is indeed possible when the ratio of the smallest diameters of the HP-air pipe and the blast pipe is chosen to lie between 0.6 and 0.9. The absolute pressure P then lies between 2 and 4.5 bar. When the diameter of the blast pipe is chosen to lie at least between 4 mm and 20 mm at this ratio, it is found that the speed of the mixture issuing from the blast pipe substantially does not change, and also that the output, i.e. the quantity of abrasive particles per unit time and per unit surface area to be treated, shows very little change. The considerable reduction in the HP-air pressure, on the other hand, renders the system energy-efficient for use in mass manufacture, such as for making many small holes in thin plates. A reduction of the absolute pressure P to 3.7 bar for a smallest diameter $d_2$ of the blast pipe of 6 mm and a smallest diameter $d_1$ of the HP-air pipe of 4.5 mm, i.e. a ratio of 0.75, leads to a power saving of approximately 45% compared with a system operating at 7 bar with diameters of 6 and 3 mm, respectively.

It does have to be true for values chosen for the absolute pressure P and the ratio $d_1/d_2$ that $P<13.25-12.5\ d_1/d_2\ )))$ because otherwise the underpressure in the mixing chamber becomes too small with a higher P-value for obtaining a sufficient venturi action. It is even possible for a backflow effect to occur.

A reduction in the operating pressure is only possible, however, in that the transport of the abrasive particles to the mixing device is not dependent on the operating pressure. Preferably, the transport mechanism is a vibratory mechanism. A vibratory transport mechanism achieves that the abrasive particles are evenly distributed during transport. Even if the distribution should be irregular during the entry of the particles from the hopper into the vibrating conveyor of the vibratory mechanism, the vibratory mechanism will ensure that the particles are evenly distributed nevertheless. An even distribution of the particles leads to a constant inflow of particles into the mixing chamber, and contributes to a flow density of the mixture issuing from the blast pipe which is as constant as possible. The use of a vibratory transport mechanism not only offers the advantage of a constant particle flow, but the quantity of the particle flow can now also be rendered controllable in a simple manner, so that the process of finishing components with such a blast system becomes a controlled process. The flow quantity can be changed through a change in the amplitude and/or frequency of the vibratory mechanism.

The invention also relates to a mixing device for use in such a blast system. Such a mixing device, which is provided with a mixing chamber into which an HP-air pipe issues and which in its turn issues into a blast pipe, is characterized in that the ratio $d_1/d_2$ of a smallest diameter $d_1$ of the HP-air pipe issuing into the mixing chamber to a smallest diameter $d_2$ of the blast pipe lies between 0.6 and 0.9.

BRIEF DESCRIPTION OF THE DRAWINGS

The invention will now be explained in more detail with reference to an embodiment depicted in a drawing, in which.

DESCRIPTION OF THE PREFERRED EMBODIMENTS

Figure 1:
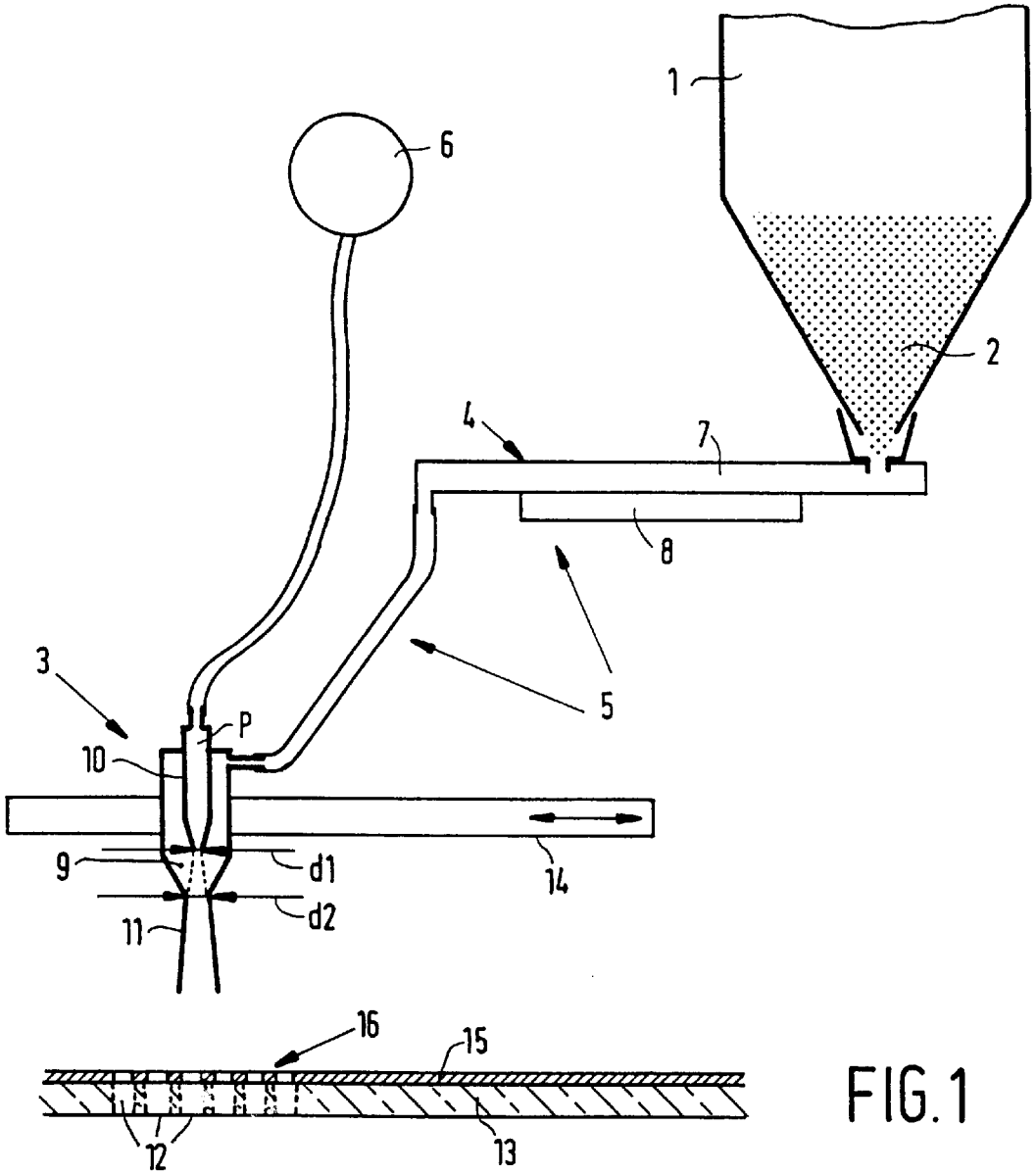
FIG. 1 shows the blast system.

The blast system is formed substantially by a hopper 1 for abrasive powder particles 2, a mixing device 3, a transport mechanism 4 for transporting the abrasive powder particles through a transport line 5 from the hopper to the mixing device, and means, for example a compressor 6, for generating HP-air which is supplied to the mixing device. The transport mechanism 4 comprises a vibratory conveyor 7 which is made to vibrate by an exciter unit 8. The mixing device comprises a mixing chamber 9 into which an HP-air pipe 10 issues. The mixing chamber itself issues into a blast pipe 11. The powder particles 2 are transported to the mixing chamber 9 by means of the vibratory conveyor 7. The desired quantity of powder to be transported by the vibratory conveyor can be accurately adjusted through changing the amplitude and frequency of the exciter unit. The powder mixes with the HP-air in the mixing chamber. The ratio $d_1/d_2$ of the smallest diameter $d_1$ of the HP-air pipe 10 to the smallest diameter $d_2$ of the blast pipe 11 lies between 0.6 and 0.9. The absolute operating pressure P supplied to the mixing chamber through the HP-air pipe lies between 2 and 4.5 bar. The mixing device operates as a Venturi tube, so that the mixture of air and powder particles flows from the blast pipe at high speed.

In the present example, the blast system is designed for making small holes 12 in a thin glass plate 13. The mixing device is for this purpose fastened on a slide 14 which can move above the glass plate and parallel to the glass plate. A mask 15 with a pattern of holes 16 is present on the glass plate. The mask is hit uniformly by a flow of abrasive powder particles in that the slide with the mixing device is moved over the glass plate at a constant speed. The glass plate is hit at the areas of the holes in the mask, so that the glass is subjected to a material-removing treatment. Cavities or, as shown in the drawing, holes can thus be made in the glass plate in a very accurate manner. Obviously, a plurality of mixing devices may be mounted on the slide, so that holes can be provided simultaneously over a large portion of a glass plate.

Figure 2:
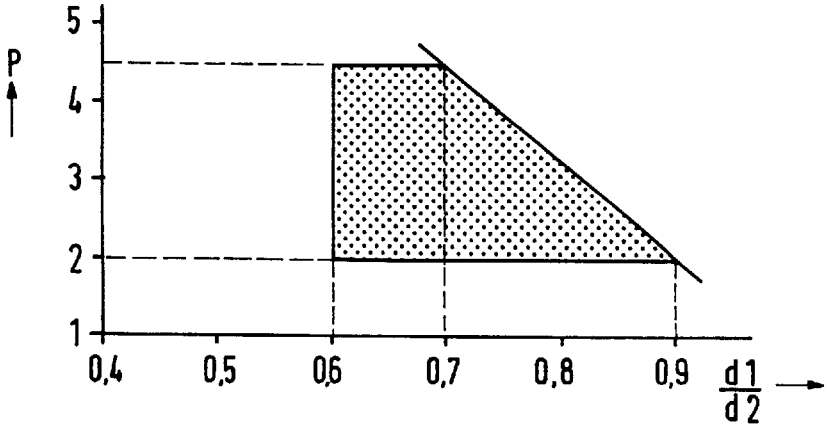
FIG. 2 shows the operating range.

In FIG. 2 the operating range in which blasting can take place effectively is shown accented. The most efficient blasting mode is obtained with a pressure P which is as low as possible in conjunction with the highest possible $d_1/d_2$ ratio, i.e. in a range for which it is true that $2<p<3$ and $0.75<d_1/d_2<0.9$, bottom right in the Figure.

We claim:

1. A blast system for processing components by means of abrasive particles, comprising a hopper for abrasive particles, a mixing device formed by a mixing chamber into which an HP-air pipe issues and which in its turn issues into a blast pipe, a transport line between the hopper and the mixing chamber through which the abrasive particles are transported from the hopper to the mixing chamber, means for generating HP-air which is supplied to the mixing chamber through the HP-air pipe for obtaining a mixture of air and abrasive particles which issues from the blast pipe, and a transport mechanism for transporting the abrasive particles through the transport line, wherein the system operates at an absolute pressure P of the HP-air of between 2 and 4.5 bar, while a ratio $d_1/d_2$ of a smallest diameter $d_1$ of the HP-air pipe issuing into the mixing chamber to a smallest diameter $d_2$ of the blast pipe lies between 0.6 and 0.9, while $P<(13.25-(12.5(d_1/d_2)))$.

2. A mixing device for an abrasive particle blast system comprising: a mixing chamber having an air inlet for receiving high pressure air, the air inlet having a smallest diameter $d_1$, a particle inlet for receiving abrasive particles and an outlet for delivering a mixture of air and abrasive particles into a blast pipe, the outlet having a smallest diameter $d_2$, wherein the ratio $d_1/d_2$ is between 0.6 and 0.9.

3. An abrasive particle blast system, comprising: a hopper for abrasive particles, a source of high pressure air at an absolute pressure P, a mixing chamber having an air inlet with a smallest diameter $d_1$ and an outlet having a smallest diameter $d_2$, the air inlet being connected to receive high pressure air from the source of high pressure air, a transport mechanism for transporting abrasive particles from the hopper into the mixing chamber at a rate that is substantially not dependent upon the value P, and a blast tube connected to the outlet of the mixing chamber for receiving a mixture of air and abrasive particles from the mixing chamber, wherein P is between 2 and 4.5 bar, the ratio $d_1/d_2$ is between 0.6 and 0.9, and P is less than $13.25-(12.5(d_1/d_2))$.

4. An abrasive particle blast system as in claim 3 wherein the transport mechanism includes a vibratory conveyor system.

5. An abrasive particle blast system as in claim 3 wherein P is between 2 and 3 bar and the ratio $d_1/d_2$ is between 0.75 and 0.9.

* * * * *